US006418853B1

(12) United States Patent
Duguet et al.

(10) Patent No.: US 6,418,853 B1
(45) Date of Patent: Jul. 16, 2002

(54) ELECTROPYROTECHNIC IGNITER WITH INTEGRATED ELECTRONICS

(75) Inventors: Jean-Rene Duguet; Jean-Pierre Vedel, both of Survilliers (FR)

(73) Assignee: Livbag SNC, Vert le Petit (FR)

( * ) Notice: Subject to any disclaimer, the term of this patent is extended or adjusted under 35 U.S.C. 154(b) by 0 days.

(21) Appl. No.: 09/505,679

(22) Filed: Feb. 17, 2000

(30) Foreign Application Priority Data

Feb. 18, 1999 (FR) ..... 99 01949

(51) Int. Cl.[7] ..... F42C 19/12

(52) U.S. Cl. ..... 102/206; 102/215; 102/202.2; 102/202.7

(58) Field of Search ..... 102/200, 202.5, 102/202.7, 202.14, 206, 215, 217; 307/10.1; 361/247, 248

(56) References Cited

U.S. PATENT DOCUMENTS

| | | | | |
|---|---|---|---|---|
| 3,999,484 | A | * | 12/1976 | Evans |
| 4,712,477 | A | * | 12/1987 | Aiko et al. |
| 4,869,170 | A | * | 9/1989 | Dahmberg et al. |
| 5,544,585 | A | | 8/1996 | Duguet ..... 102/202.5 |
| 5,889,228 | A | * | 3/1999 | Ewick et al. |
| 6,070,531 | A | * | 6/2000 | Hansen et al. |
| 6,079,332 | A | * | 6/2000 | Marshall et al. |
| 6,082,265 | A | * | 7/2000 | Sakamoto et al. |
| 6,085,659 | A | * | 7/2000 | Beukes et al. |
| 6,166,452 | A | * | 12/2000 | Adams et al. |
| 6,173,651 | B1 | * | 1/2001 | Pathe et al. |

FOREIGN PATENT DOCUMENTS

| | | |
|---|---|---|
| DE | 197 21 839 A1 | 10/1998 |
| EP | 0 520 360 A1 | 12/1992 |
| EP | 0 555 651 A1 | 8/1993 |
| EP | 0717259 A1 * | 6/1996 |
| EP | 0 717 259 A1 | 6/1996 |
| FR | 2 672 675 | 8/1992 |
| FR | 2 710 404 | 3/1995 |
| FR | 2 760 525 | 9/1998 |
| WO | WO 97/21067 | 6/1997 |
| WO | WO 98/25100 | 6/1998 |
| WO | WO 99/02937 | 1/1999 |
| WO | WO 99/05469 | 2/1999 |

OTHER PUBLICATIONS

Derwent Abstract of EP 863 379 (corresponding to FR 2,760, 525).

Derwent Abstract of EP 588 685 (corresponding to FR 2,710,404).

* cited by examiner

*Primary Examiner*—Michael J. Carone
*Assistant Examiner*—Troy Chambers
(74) *Attorney, Agent, or Firm*—Pillsbury Winthrop LLP

(57) ABSTRACT

The electropyrotechnic igniter (1) comprises a body divided into a downstream chamber and an upstream chamber by a discoid metal piece (8), the downstream chamber containing a resistive heating element (11), a pyrotechnic initiating composition (12) and a pyrotechnic ignition composition (7), and the upstream chamber containing a rectangular electronic card (17) extended by three external metal pins (29 to 31), on which electronic card conducting tracks are provided. Two metal connection pins (13, 14) pass through the discoid metal piece (8) and connect the said conducting tracks to the resistive heating element (11). A means of intercommunicating and of triggering a train of specific electric pulses as well as a means of storing electrical energy are connected to the conducting tracks. This igniter is more especially intended to be used in motor-vehicle safety, especially for constituting the device for igniting a gas generator associated with an airbag.

7 Claims, 3 Drawing Sheets

ELECTROPYROTECHNIC IGNITER WITH INTEGRATED ELECTRONICS

The present invention relates to the field of motor-vehicle safety and concerns more particularly an electropyrotechnic igniter.

Over the last 30 years, many electropyrotechnic igniters have appeared and are widely used for constructing either the ignition devices for gas generators intended for inflating airbags for protecting the occupants of a motor vehicle or the gas microgenerators included in seat-belt pretensioners.

Conventionally, electropyrotechnic igniters comprise, on one side, metal pins connected to a source of electric current and between which a ferrite core is generally placed and, on the other side, a resistive heating element which is attached to the said metal pins and which is covered with a pyrotechnic initiating composition. As described in Patent Application FR 2,704,944 or in its corresponding patent U.S. Pat. No. 5,544,585, the resistive heating element may consist of a resistive heating strip incorporated into a printed subcircuit.

An electropyrotechnic igniter of elongate shape and of small diameter, allowing the metal pins and the ferrite cores to be omitted by integrating their functions into a complete printed circuit, has also been proposed, in Patent Application FR 2,760,525. However, because of its particular geometrical configuration, this igniter cannot be used instead of the igniters commonly used in gas generators and in seat-belt pretensioners.

Moreover, the greatly increased number of "airbag modules" incorporated into a motor vehicle—an "airbag module" consisting of a particular entity containing a gas generator associated with an airbag—results in an increased number of igniters employed. In order to avoid having to make individual electrical connections between each igniter and the source of electric current, which would mean excessively high installation costs and too much space being taken up, it is therefore desirable to incorporate, into the gas generators of the various airbag modules, igniters that can be connected to a central control unit via a hard-wired circuit so as to limit the number of cables placed in the vehicle. But this results in several problems to be solved consisting of the fact that:

- such an igniter must have an overall external size similar to that of an igniter normally used, so as to be able to replace the latter in airbag modules;
- in the event of a collision, the central control unit may not be able to deliver enough electrical energy to cause the various igniters included in the airbag modules to be initiated; and
- depending on the nature and the severity of the collision for example, it is desirable to be able to choose to trigger only the airbag modules allowing a suitable protection to be provided.

Those skilled in the art are therefore always seeking electropyrotechnic igniters capable of being integrated into a hard-wired circuit connected to a central control unit and having an overall external size similar to that of conventional igniters.

The subject of the invention is specifically to provide such an igniter and therefore relates to an electropyrotechnic igniter comprising a body having a resistive heating element, a pyrotechnic initiating composition and a pyrotechnic ignition composition, the said resistive heating element being electrically connected to at least two external electrodes attached to a printed-circuit substrate produced in the form of an electronic card on which conducting tracks are provided, characterized in that:

i) a transverse separating wall divides the inside of the body into a downstream chamber, containing the resistive heating element, the pyrotechnic initiating composition and the pyrotechnic ignition composition, and an upstream chamber, containing the electronic card;

ii) electrical connection means pass through the said transverse separating wall and connect the conducting tracks on the electronic card to the resistive heating element;

iii) a means of intercommunicating and of triggering coded information as well as a means of storing electrical energy are connected to the conducting tracks.

It therefore follows that:

- this electropyrotechnic igniter can be used for the same purpose as a conventional igniter since the use of an electronic card on which the various electronic components are integrated makes it possible for the said igniter forming the subject of the invention to have an overall external size similar to that of a conventional igniter;
- the use of such an igniter in each of the various airbag modules incorporated into the vehicle and connected via a bus-type hard-wired circuit to a central control unit makes it possible, on the one hand, to leave to the central control unit the choice of triggering only the airbag module or modules capable of providing the occupant with effective protection depending on the impact and, on the other hand, of no longer requiring the central control unit to deliver the amount of electrical energy needed to cause such an igniter to be initiated. This is achieved by the presence in each igniter, on the one hand, of a means of storing electrical energy which is periodically supplied with a low-intensity electric current emitted by the central control unit and, on the other hand, of an intercommunicating and triggering means which is capable of detecting an item of coded information coming from the central control unit and of giving the said means of storing electrical energy the command to deliver the amount of electrical energy stored until then. This allows the resistive heating element to be heated by the Joule effect so as to initiate the pyrotechnic initiating composition.

Preferably, the intercommunicating and triggering means will be a specific integrated circuit and the coded information which flows between the central control unit and the said intercommunicating and triggering means will consist of trains of specific electrical pulses. In the present application, the coded information will comprise both the information constituting the commands for triggering the various igniters and the information allowing the central control unit to be sure of the reliability of the electronic components contained in each igniter.

Also preferably, the intercommunicating and triggering means is placed on one of the two plane faces of the electronic card and the means of storing electrical energy is placed on the other plane face.

Advantageously, the transverse separating wall is produced using a metal piece with several perforations, each of these perforations having a glass side wall. Advantageously, the metal piece has two perforations and the electrical connection means consist of two metal connection pins, each of the latter being inserted into one of the two perforations in the metal piece and having a first end attached to the resistive heating element and a second end soldered to the conducting tracks. This transverse separating wall therefore makes it possible to ensure sealing between the upstream chamber and the downstream chamber, before and after operation of the igniter, but also to electrically isolate the metal connection pins from each other.

Also advantageously, the electronic card is placed at right angles to the transverse separating wall. In order to increase the mechanical strength of the electronic card and of the electronic components fastened onto it, it is desirable to cover the whole assembly with an overmoulding compound or with an encapsulation compound.

Preferably, the resistive heating element consists of a thin-film resistive bridge resting on the metal piece, the said thin-film resistive bridge being made of tantalum nitride with a thickness of between 0.01 $\mu$m and 1 $\mu$m. The resistive bridge may also consist, for example, of a layer of a nickel-chromium alloy. Also preferably, the pyrotechnic initiating composition is a lacquer based on lead trinitroresorcinate which covers the resistive bridge. The said pyrotechnic initiating composition may also consist, for example, of dinitrobenzofuroxan salts.

Preferably, the external electrodes consist of external metal pins which are placed in the extension of the electronic card and which are parallel to this card.

Also preferably, the means of storing electrical energy consists of a capacitor.

The invention also relates to the use of such electropyrotechnic igniters in gas generators for airbag modules connected in a motor vehicle by a bus-type hard-wired circuit to a central control unit.

Described below, in FIGS. 1 and 2, is the preferred embodiment of the invention and, in FIG. 3, the circuit diagram of an example of a bus-type hard-wired circuit.

Figure 1:
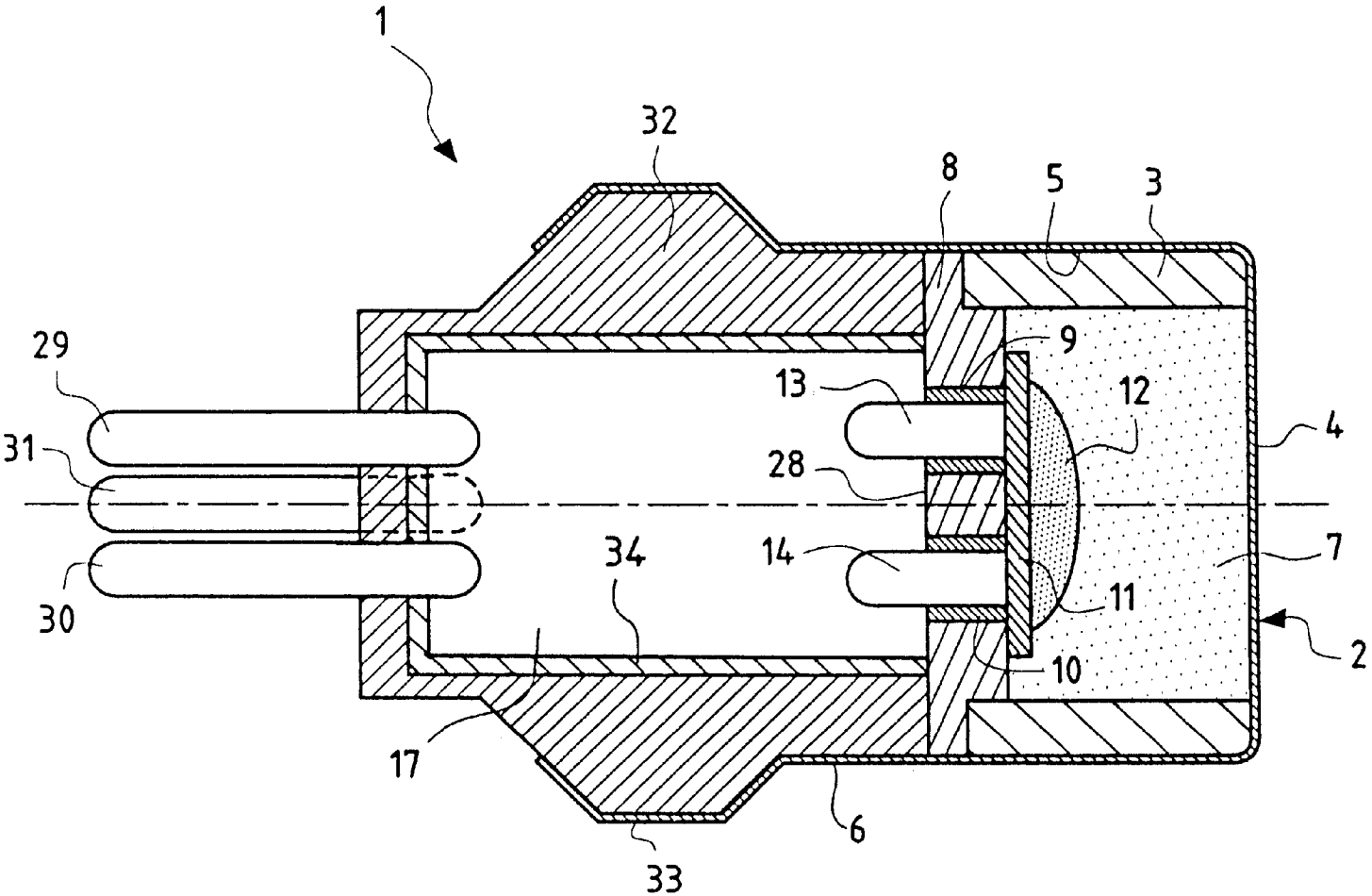
FIG. 1 is a partial longitudinal sectional view of an electropyrotechnic igniter according to the preferred embodiment of the invention, with the electronic components and part of the encapsulation omitted.
Figure 2:
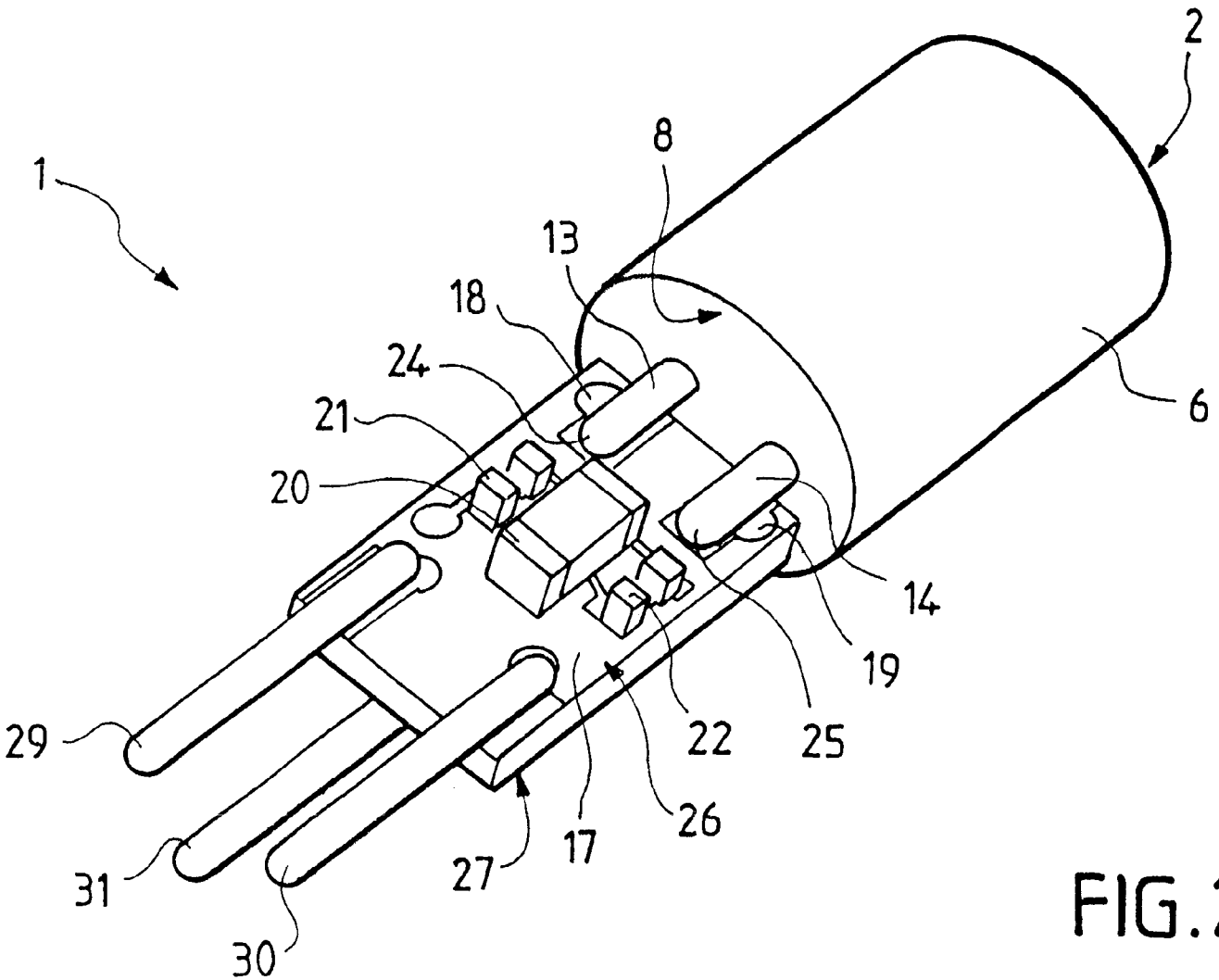
FIG. 2 is a perspective cut-away view of the igniter shown partially in FIG. 1, with the encapsulation omitted.

Referring to FIGS. 1 and 2, it may be seen that an electropyrotechnic igniter 1 according to the invention consists of a cap 2 which is provided with a side wall 6 terminating, on one side, in a bottom 4 and, on the other side, in a free end 33, into which cap is firstly inserted a cylindrical sleeve 3. The latter has a first end which bears against the bottom 4 of the cap 2 and a side wall 5 whose external surface is in contact with part of the internal surface of the side wall 6 of the cap 2. A pyrotechnic ignition composition 7 in the form of a pulverulent substance is then introduced into the cap 2. Finally, an assembly, described below, is slipped into the said cap 2.

This assembly consists of a glass penetration comprising, firstly, a discoid metal piece 8 having an upstream face and a downstream face to which a resistive heating element 11 is attached and, secondly, two metal connection pins 13, 14. More specifically, the discoid metal piece 8 is provided with two perforations each having a glass side wall 9, 10, the two metal connection pins 13, 14 are each introduced into one of the two perforations, and the said pins 13, 14 each have a first end fastened by soldering to the resistive heating element 11. The latter is advantageously produced using a thin-film resistive bridge made of tantalum nitride with a thickness of approximately 0.5 $\mu$m. A printed-circuit substrate, in the form of a rectangular electronic card 17 having an upper plane face 26 and a lower plane face 27 on which conducting tracks 18, 19 are provided, is attached to the connection pins 13, 14. More specifically, the second end 24, 25 of each of the two connection pins 13, 14 is fastened by soldering to the conducting tracks 18, 19 on the upper plane face 26 so that the edge 28 of the rectangular electronic card 17 is in contact with the upstream face of the discoid metal piece 8. A means 20 of storing electrical energy, consisting of a capacitor, and means 21, 22 for protecting against electrostatic discharges and against electromagnetic interference are connected to the conducting tracks 18, 19 on the upper plane face 26 and a means for intercommunicating and for triggering a train of specific electrical pulses is connected to the conducting tracks 18, 19 on the lower plane face 27. This intercommunicating and triggering means is advantageously produced by a specific integrated circuit. Moreover, the rectangular electronic card 17 is extended by three external metal pins 29 to 31, each having an end fastened by soldering to the conducting tracks 18, 19, the said external pins 29, 30 being fastened to the upper plane face 26 and intended to be integrated into a bus-type hard-wired circuit attached to a central control unit and the external pin 31 being fastened to the lower plane face 27 and providing the earth.

A pyrotechnic initiating composition 12 in the form of a lacquer based on lead trinitroresorcinate is deposited on the resistive heating element 11 and the whole assembly as described above is introduced into the cap 2, the discoid metal piece 8 being placed so as to bear against the second end of the cylindrical sleeve 3.

A plastic piece 32 is inserted into the cap 2 and the free end 33 of the latter is crimped onto the piece 32. A thermosetting encapsulation polymer is then injected via an orifice in the piece 32 so as to fill the inside of the piece 32.

An electropyrotechnic igniter 1 as described above operates as follows.

Under normal operating conditions, that is to say when the motor vehicle into which the said igniter 1 is incorporated is not involved in any particular accident requiring the deployment of an airbag so as to protect the occupant, the means 20 of storing electrical energy, consisting here of a capacitor, is periodically supplied with a low-intensity current emitted by the central control unit and transmitted to the said capacitor via the external pins 29 and 30.

If, following an impact, activation of the igniter 1 is desirable so as to initiate the gas generator with which it is associated, the central control unit delivers a trigger command in the form of a train of specific electrical pulses which can be detected only by the intercommunicating and triggering means included in the igniter 1. This intercommunicating and triggering means then makes it possible to actuate the capacitor which is therefore forced to release, into the two connection pins 13, 14 and therefore into the resistive heating element 11, the amount of electrical energy which was stored. The said resistive heating element 11 then causes, by the Joule effect, the initiation of the pyrotechnic initiating composition 12 and subsequently the combustive initiation of the pyrotechnic ignition composition 7, which has the effect of fracturing the bottom 4 of the cap 2.

Moreover, given the mechanical strength of the discoid metal piece 8, a major advantage resides in the fact that, during activation of the igniter 1, the various electronic components are not damaged by the pressure wave resulting from the initiation of the pyrotechnic initiating composition 12, and the intercommunicating and triggering means is therefore also capable of exchanging information with the central control unit in the following milliseconds, especially in order to indicate, for example, that the igniter 1 has been correctly triggered.

Figure 3:
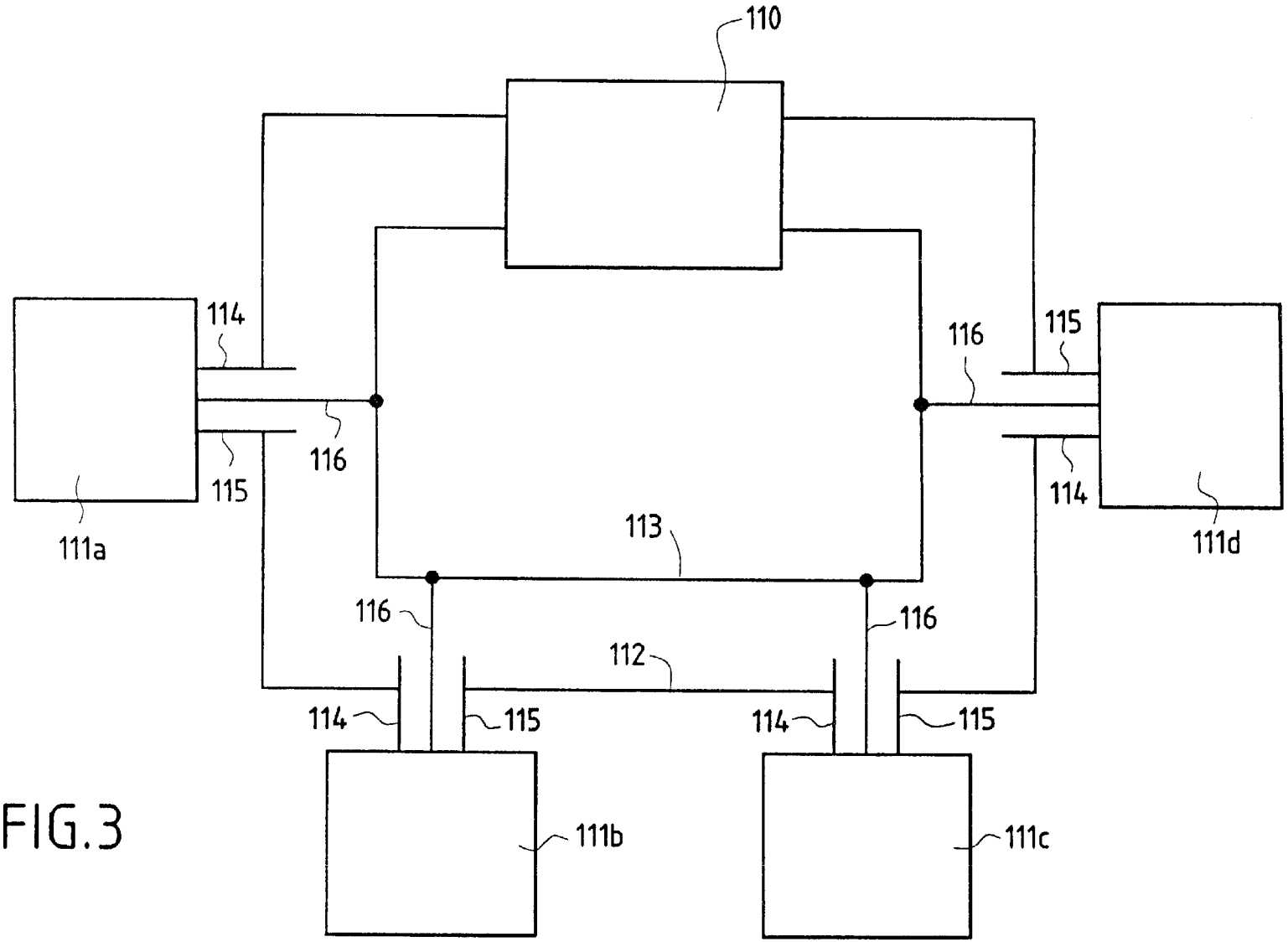
FIG. 3 is a circuit diagram of a bus-type hard-wired circuit in which four airbag modules are integrated, each containing an electropyrotechnic igniter shown in FIGS. 1 and 2.

FIG. 3 shows a diagram illustrating an example of a bus-type hard-wired circuit into which a central control unit 110 and four airbag modules 111*a*, 111*b*, 111*c* and 111*d* have been integrated, the two airbag modules 111*b* and 111*c* possibly each containing, for example, a gas generator intended to inflate a front airbag and the two other airbag modules 111*a* and 111*d* possibly each containing, for example, a gas generator intended to inflate a side airbag.

The gas generator included in each of these various modules contains an electropyrotechnic igniter as described above, which therefore has three external metal pins 114 to 116, the two external pins 114 and 115 being intended to be connected to a first electrical supply conductor 112 attached to the central control unit 110 and the external pin 116 being intended to be connected to a second electrical conductor 113 also attached to the central control unit 110 and serving as earth.

Under normal operating conditions, that is to say when the motor vehicle is not involved in any particular impact requiring one or more airbag modules 111*a*, 111*b*, 111*c* and 111*d* to be activated, the central control unit 110 periodically delivers a low-intensity electric current into the first electrical supply conductor 112, and this electric current is sent to the means of storing electrical energy of the igniter included in each of the four airbag modules 111*a*, 111*b*, 111*c* and 111*d* via the external pins 114 and 115.

If, following an impact, it is desirable to activate the airbag 111*c* for example, the central control unit 110 delivers into the first electrical supply conductor 112 a train of specific electrical pulses constituting a triggering command intended for the igniter of the airbag module 111*c*. This train of specific electrical pulses is sent to each igniter via the external pins 114 and 115, but only the intercommunicating and triggering means included in the igniter of the airbag module 111*c* is capable of detecting it and of analysing it. The means of storing electrical energy associated with the intercommunicating and triggering means included in the igniter of the airbag module 111*c* is then activated and it causes the pyrotechnic initiating composition to be initiated as described above.

If, following an impact, it is desirable to activate several airbag modules, for example the airbag modules 111*a* and 111*b*, the central control unit 110 then delivers into the first electrical supply conductor 112 the trains of specific electrical pulses intended for the igniter included in each of the airbag modules 111*a* and 111*b*. The operation of each of the two igniters is then similar to that analysed above.

What is claimed is:

1. Electropyrotechnic igniter (1) comprising a body having a resistive heating element (11), a pyrotechnic ignition composition (7), the said resistive resistive heating element (11) being electrically connected to at least two external electrodes attached to a printed-circuit substrate produced in the form of an electronicc card (17) on which conducting tracks (18, 19) are provided, characterized in that:

i) a transverse separating wall (8) divides the inside of the body into a downstream chamber, containing the resistive heating element (11), the pyrotechnic initiating composition (12) and the pyrotechnic ignition composition (7), and an upstream chamber containing the electronic card (17);

ii) electrical connection means pass through the said transverse separating wall (8) and connect the conducting tracks (18, 19) on the electronic card (17) to the resistive heating element (11);

iii) a means of intercommunicating and of triggering coded information as well as a means (20) of storing electrical energy are connected to the conducting tracks (18, 19), said transverse separating wall (8) comprising a metal piece (8) with several perforations, each of these perforations having a glass side wall (9, 10).

2. Electropyrotechnic igniter (1) according to claim 1, wherein the resistive heating element (11) comprises a thin-film resistive bridge resting on the metal piece (8) and said thin-film resistive bridge comprises tantalum nitride with a thickness of between 0.01 $\mu$m and 1 $\mu$m.

3. Electropyrotechnic igniter (1) according to claim 1 wherein the resistive heating element (11) comprises a thin-film resistive bridge resting on the metal piece (8) and said thin-film resistive bridge comprises a layer of nickel/chromium alloy with a thickness of between 0.01 $\mu$m and 1 $\mu$m.

4. Electropyrotechnic igniter (1) according to claim 1, wherein the electrical connection means comprise two metal connection pins (13, 14), each of the latter being inserted into one of the perforations in the metal piece (8) and having a first end attached to the resistive heating element (11) and a second end soldered to the conducting tracks (18, 19).

5. Electropyrotechnic igniter (1) according to claim 1, characterized in that the resistive heating element (11) consisting of a thin-film resistive bridge resting on the metal piece (8).

6. Electropyrotechnic igniter (1) according to claim 2 or claim 3 wherein the pytrotechnic initiating composition (12) comprises a lacquer based on lead trinitroresorcinate which covers the resistive bridge.

7. Electropytrotechnic igniter (1) according to claim 2 or claim 3 wherein the pyrotechnic initiating composition (12) comprises a lacquer based on a dinitrobenzofuroxan salt.

* * * * *